US009839810B1

(12) United States Patent
Tzeng

(10) Patent No.: US 9,839,810 B1
(45) Date of Patent: Dec. 12, 2017

(54) FITNESS MACHINE WITH CONTINUOUSLY VARIABLE MAGNETIC-CONTROLLED DAMPING FORCE AND COMBINED WITH MANUAL EMERGENCY BRAKE

(71) Applicant: Yuan-Kwei Tzeng, Miaoli County (TW)

(72) Inventor: Yuan-Kwei Tzeng, Miaoli County (TW)

( * ) Notice: Subject to any disclaimer, the term of this patent is extended or adjusted under 35 U.S.C. 154(b) by 0 days.

(21) Appl. No.: 15/367,188

(22) Filed: Dec. 2, 2016

(51) Int. Cl.

| | |
|---|---|
| ***A63B 24/00*** | (2006.01) |
| ***A63B 21/00*** | (2006.01) |
| ***A63B 21/005*** | (2006.01) |
| ***A63B 21/22*** | (2006.01) |
| ***A63B 22/06*** | (2006.01) |

(52) U.S. Cl.
CPC ..... *A63B 24/0087* (2013.01); *A63B 21/0053* (2013.01); *A63B 21/00072* (2013.01); *A63B 21/00192* (2013.01); *A63B 21/225* (2013.01); *A63B 22/0605* (2013.01)

(58) Field of Classification Search
CPC ..... A63B 21/00072; A63B 21/00192; A63B 21/0053; A63B 21/225; A63B 24/0087; A63B 22/0605
See application file for complete search history.

(56) References Cited

U.S. PATENT DOCUMENTS

| | | | | |
|---|---|---|---|---|
| 7,601,097 | B2 * | 10/2009 | Miyamaru | A63B 22/0605 434/61 |
| 9,446,277 | B2 * | 9/2016 | Irving | A63B 21/225 |
| 9,707,443 | B2 * | 7/2017 | Warren | A63B 23/0476 |
| 2013/0123074 | A1 * | 5/2013 | Jun | A63B 21/00196 482/57 |

FOREIGN PATENT DOCUMENTS

| | | |
|---|---|---|
| CN | 201064638 Y | 5/2008 |
| CN | 202263342 U | 6/2012 |
| CN | 205549351 U | 9/2016 |

* cited by examiner

*Primary Examiner* — Glenn Richman

(57) ABSTRACT

A fitness machine with continuously variable magnetic-controlled damping force and combined with a manual emergency brake includes a fitness bike, a console, a magnetically controlled damping device and a resistance and brake control device. The fitness bike generates and supplies power to the console, magnetically controlled damping device and resistance and brake control device by a rotating flywheel. The magnetically controlled damping device produces continuously variable electromagnetic damping force to the flywheel. The resistance and brake control device allows a user to operate in two different modes of the continuously variable electrically controlled brake and manual emergency brake, and the function of the continuously variable electrically controlled brake may control the flywheel to produce continuously variable electromagnetic damping, so as to achieve the results of generating and supplying the required electric power, providing the continuously variable controlled damping force of the fitness bike, and combining a gradual-change brake and a multi-functional brake.

14 Claims, 9 Drawing Sheets

FITNESS MACHINE WITH CONTINUOUSLY VARIABLE MAGNETIC-CONTROLLED DAMPING FORCE AND COMBINED WITH MANUAL EMERGENCY BRAKE

BACKGROUND OF INVENTION

1. Field of the Invention

The present invention relates to a fitness machine, in particular to the fitness machine with continuously variable magnetic-controlled damping force and combined with a manual emergency brake.

2. Description of the Related Art

In general, a conventional fitness bike (also known as flywheel bike) has the similar function of riding a bicycle and allows a user to perform fitness or special physical training indoors. A general fitness bike comes with a bike frame, a seat, a handlebar, pedals, a transmission system, a flywheel, a brake device, etc and lets the user sit on the seat, so that the user's legs can apply forces onto the pedals alternatively, and then uses the transmission system to drive the flywheel to rotate. Since the flywheel has specific inertia, therefore the user must apply a specific pedaling force to achieve the exercise, workout, and training results. To increase the resistance of the user in pedaling for a high intensive exercise, the conventional fitness bike is equipped with a damping device which is usually a mechanical structure such as the ones disclosed in P.R.C. Pat. Publication Nos. CN202263342U and CN201064638Y. Since the mechanical damping device has a complicated structure, and the damping cannot be adjusted accurately in the continuously variable manner (the numerical value of the damping is not shown), therefore some of the conventional fitness bikes adopt an electromagnetic damping device such as the one disclosed in P.R.C. Pat. Publication No. CN205549351U and provided for adjusting the damping of the fitness bike through electromagnetism. However, the conventional fitness bike equipped with the electromagnetic damping device requires an external electric power supply, and the damping is adjusted in stages, and such conventional fitness bike usually fails to comply with the users' requirements. In addition, the brake device of the conventional fitness bike cannot be braked by a mode with gradual change or used for producing the damping force. Obviously, the conventional fitness bikes required further improvements.

SUMMARY OF THE INVENTION

In view of the drawbacks of the prior art, the inventor of the present invention based on years of experience in the related industry to conduct extensive researches and experiments, and finally developed a fitness machine with continuously variable magnetic-controlled damping force and combined with a manual emergency brake to achieve the effects of supplying electric power by self power generation, providing a continuously variable controlled damping force of the fitness bike, and integrating a manual emergency brake and a multifunctional brake into the fitness bike.

Therefore, it is a primary objective of the present invention to provide a fitness machine with continuously variable magnetic-controlled damping force and combined with a manual emergency brake, to use a power generating device to generate and supply electric power to a console, to magnetically control the damping device, and to combine a resistance and brake control device, so that the resistance and brake control device can transmit a signal to the console to control and the magnetically controlled damping device, so as to produce the damping force by the flywheel of the fitness bike.

A secondary objective of the present invention is to provide a fitness machine with continuously variable magnetic-controlled damping force and combined with a manual emergency brake, and the fitness machine has a resistance and brake control device with an electrically controlled brake and combines with the related mode of a manual emergency brake for users' option, and the function of the electrically controlled brake may be used for controlling the brake of the fitness bike in a damping force.

A further objective of the present invention is to provide a fitness machine with continuously variable magnetic-controlled damping force and combined with a manual emergency brake, and the function of the electrically controlled brake of the resistance and brake control device can be achieved by applying an encoder with photo-interrupter and a Hall-effect sensor with magnet.

To achieve the aforementioned and other objectives, the present invention provides a fitness machine with continuously variable magnetic-controlled damping force and combined with a manual emergency brake, preferably comprising: a fitness bike, a console, a magnetically controlled damping device and a resistance and brake control device, wherein the fitness bike has a bike body, a flywheel installed to the bike body and pedaled to rotate, a brake device disposed adjacent to the flywheel, a control unit combined into the bike body, a power generating device installed in the flywheel for generating electric power by a rotating moment and supplying the electric power to the control unit; wherein the console is installed to the fitness bike and electrically coupled to the control unit and provided for a user's operation; wherein the magnetically controlled damping device is combined to the bike body of the flywheel, and the magnetically controlled damping device has a yoke, and an electromagnetic coil wound around the yoke, and the yoke has two magnetic poles extended to both sides of the flywheel respectively, and the electromagnetic coil is electrically coupled to the console and the control unit, and the console provides a control signal to the control unit for controlling the magnetically controlled damping device to generate a magnetic damping force to the flywheel; wherein the resistance and brake control device includes a hand lever, a moving block combined to a lever body of the hand lever, a rotating member combined to a working end of the hand lever, a sensing unit installed to the moving block and configured to be corresponsive to the rotating member, and a brake push rod or a brake cable combined to the hand lever or the moving block; wherein the hand lever is turned while the rotating member is being rotated, and the sensing unit senses the angle of rotation of the rotating member to generate and feed back a signal to the control unit and provided for the control unit to control the magnetically controlled damping device to produce a magnetic damping force to the flywheel; and wherein the hand lever is provided for being pressed or pushed to drive the brake push rod, and the brake push rod is provided for pushing the brake device of the fitness bike.

In the fitness machine with continuously variable magnetic-controlled damping force and combined with a manual emergency brake, the brake push rod may be substituted by a brake cable connected to the brake device connected to a farther end of the fitness bike.

The fitness machine with continuously variable magnetic-controlled damping force and combined with a manual emergency brake of the present invention has the following effects:

(1) The power generating device generates the electric power required by the console and the magnetically controlled damping device without requiring an additional external electric power to achieve the function of adjusting the damping.

(2) The damping of the magnetically controlled damping device produced by applying the flywheel can be adjusted in a continuously variable manner to meet the requirements of individual users.

(3) The resistance and brake control device is a multi-functional brake device integrating two different modes including the electrically controlled brake and the manual emergency brake and provided as options for user requirement.

(4) The mode of the electrically controlled brake of the resistance and brake control device can be used for generating a signal to the console to control the magnetically controlled damping device to produce a continuously variable magnetic-controlled damping or braking force to the flywheel of the fitness bike.

DESCRIPTION OF THE INVENTION

The above and other objects, features and advantages of this disclosure will become obvious from the following detailed description accompanied by the drawings.

Figure 1:
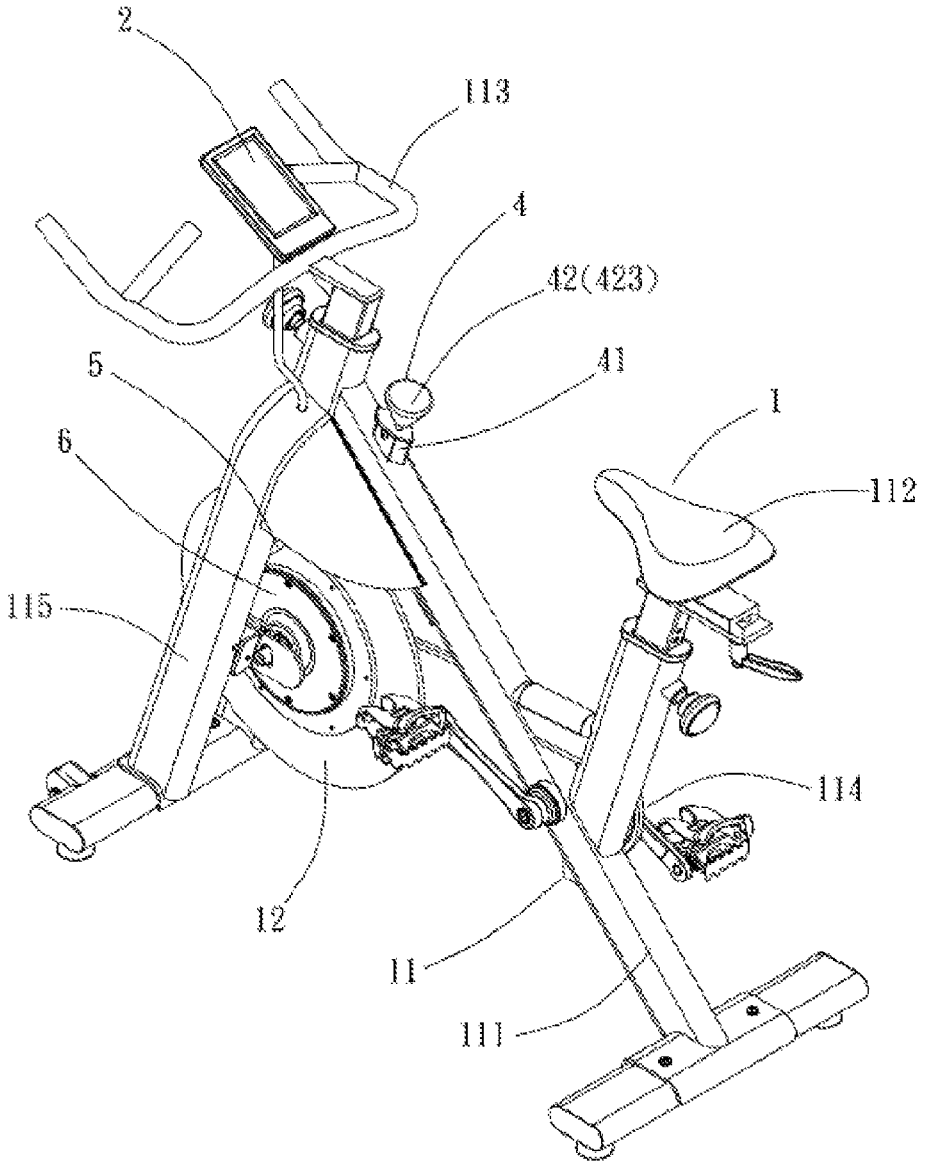
FIG. 1 is a perspective view of an embodiment of the present invention applied to a fitness machine.
Figure 2:
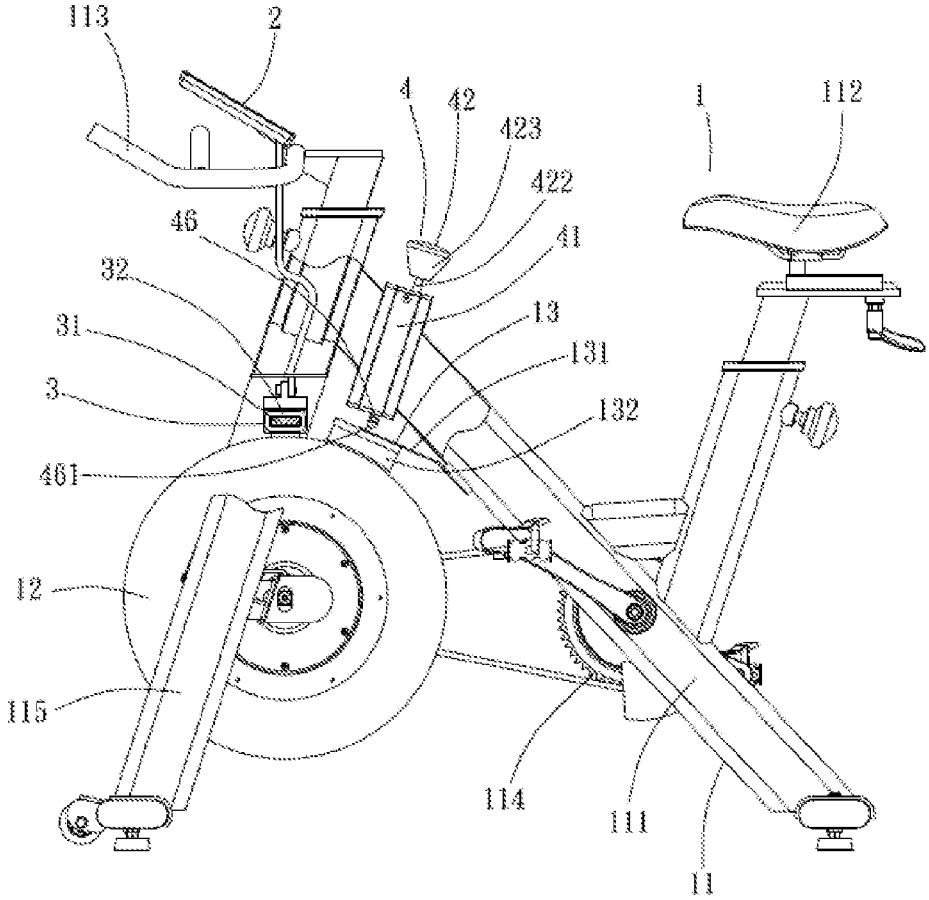
FIG. 2 is a side view of an embodiment of the present invention applied to a fitness machine.
Figure 3:
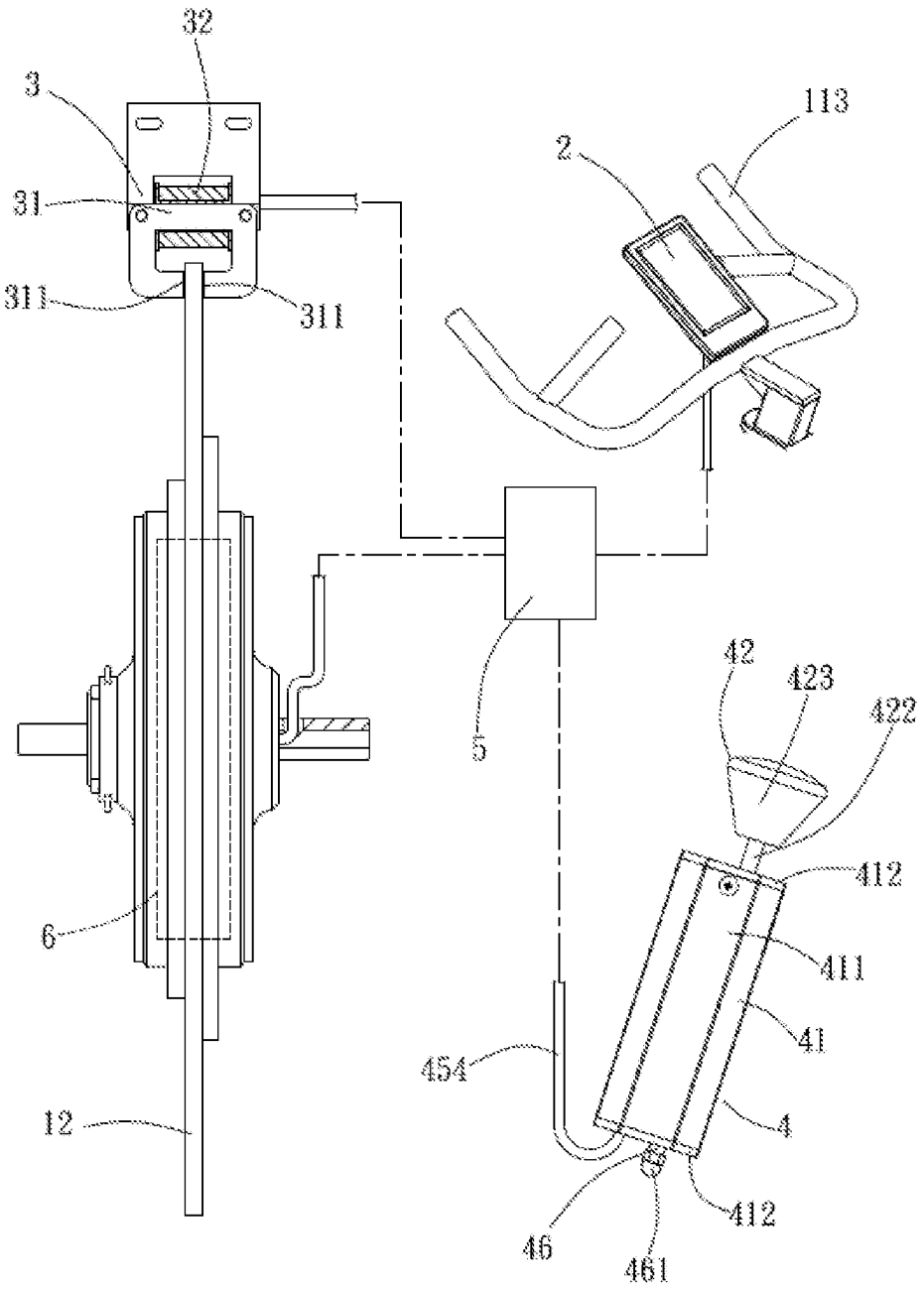
FIG. 3 is a schematic view of an embodiment of the present invention with a continuously variable magnetic-controlled damping force and combined with a manual emergency brake.
Figure 4:
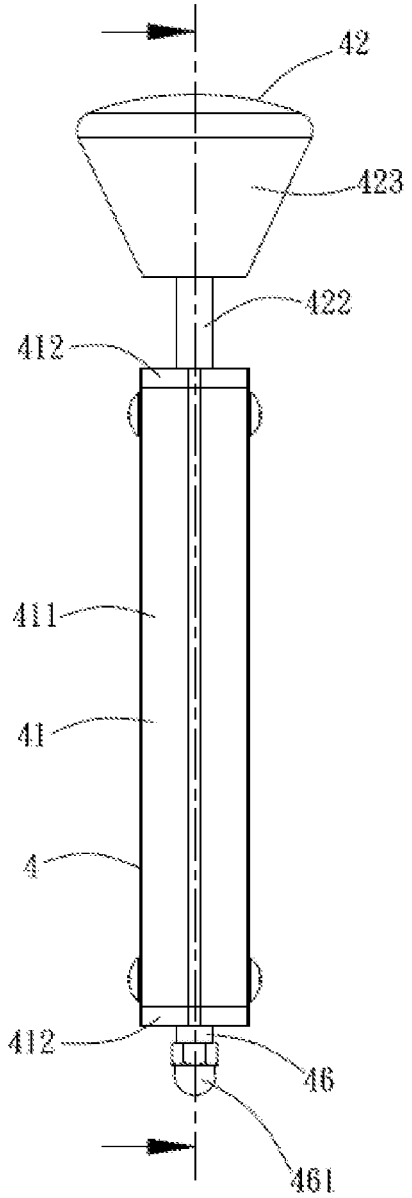
FIG. 4 is a side view of a resistance and brake control device in accordance with a first embodiment of the present invention.

With reference to FIGS. 1, 2 and 3 for a fitness machine with continuously variable magnetic-controlled damping force and combined with a manual emergency brake in accordance with this present invention, the fitness machine is a kind of fitness bike (flywheel bike) capable of controlling the damping force of the flywheel in a continuously variable manner and combined with a manual emergency brake. In an embodiment, the invention comprises a fitness bike 1, a console 2, a magnetic-controlled damping device 3 and a resistance and brake control device 4.

Figure 11:
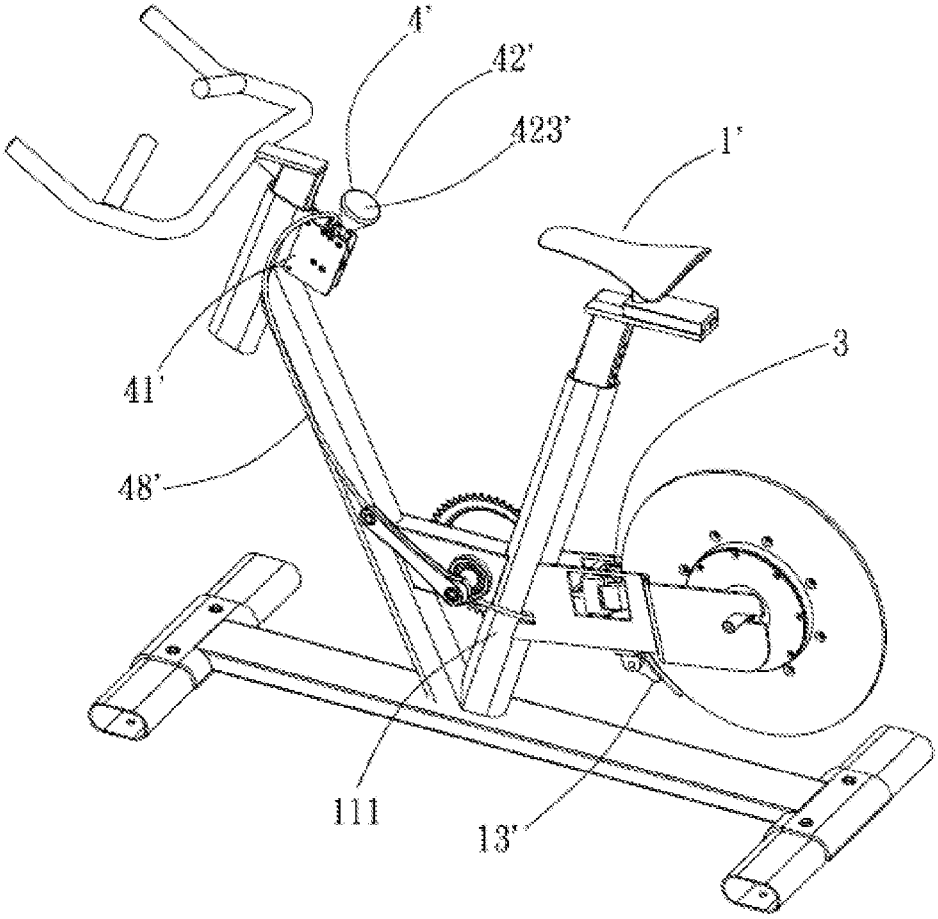
FIG. 11 is a schematic view of a using status of a resistance and brake control device in accordance with the second embodiment of the present invention.

In FIGS. 1 and 2, the fitness bike 1 has a bike body 11, a flywheel 12 installed to the bike body 11 and provided for a user to pedal to rotate the flywheel 12, a brake device 13 installed adjacent to the flywheel 12, a control unit 5 combined into the bike body 11, a power generating device 6 installed in the flywheel 12 for generating electric power by a rotating moment and supplying the electric power to the control unit 5; wherein the bike body 11 has a bike frame 111, a seat 112, a handlebar 113 and a pedal system 114, and the flywheel 12 is installed at the front fork 115 of the bike frame 111 (as shown in FIG. 1), or installed at the rear fork of the bike frame 111 (as shown in FIG. 11); the brake device 13 may have a bracket 131 fixed to the bike frame 111, and a brake pad 132 combined to the bracket 131 and installed adjacent to the circumference or any side of the flywheel 12, and the brake pad 132 is provided for touching the flywheel 12 to produce a braking force; the control unit 5 may be installed in the bike frame 111 for controlling the power generating device 6, the magnetic-controlled damping device 3 and the resistance and brake control device 4, and the control unit 5 may also have a rechargeable battery (not shown in the figure) for storing electric power to supply all electric power required by the fitness bike 1; the power generating device 6 is a prior art and the flywheel 12 may have a rotor, a stator, etc (not shown in the figure) installed therein, and the rotor has a plurality of permanent magnets, and the stator has a plurality of coils. The power generating device 6 and the stator provide the power generation function through the rotation of the flywheel 12 and the rotor, so as to supply the required electric power of the fitness bike 1.

In FIGS. 1 and 3, the console 2 is installed at the front of the handlebar 113 of the fitness bike 1 and electrically coupled to the control unit 5, the magnetic-controlled damping device 3 and the resistance and brake control device 4. The control unit 5 controls the power supply to the console 2, so that the console 2 is provided for a user to operate and control different functions of the fitness bike 1 or view information such as the workout/training status of the fitness machine.

In FIG. 3, the magnetic-controlled damping device 3 is combined to the flywheel 12 at the top or the bike body 11 on a side. In a preferred embodiment, the magnetic-controlled damping device 3 has a yoke 31, and an electromagnetic coil 32 wound around the yoke 31; the yoke 31 is substantially in C-shaped, such that the yoke 31 has two magnetic poles 311 formed thereon and disposed adjacent to both sides of the flywheel 12 respectively; the electromagnetic coil 32 is wound to the middle of the yoke 31 and electrically coupled to the control unit 5, so that a user may use the console 2 and the control unit 5 to control the magnetic damping force of the magnetic-controlled damping device 3 to produce damping force to the flywheel 12. Specifically, a current is passed through the electromagnetic coil 32, so that the two magnetic poles 311 of the yoke 31 produce an electromagnetic field to achieve the magnetic damping result, so that the electromagnetic field produces a rotating resistance to the flywheel 12 to control the pedaling resistance of the fitness bike 1. In addition, when the electromagnetic field is controlled and adjusted to a specific numerical value, the electromagnetic field may also be used to make the flywheel 12 near to a substantially stop status. Now, a manual emergency bake is combined to achieve the function of braking and stopping the fitness bike completely.

In FIGS. 4 to 7, the resistance and brake control device 4 is a multifunctional brake device integrating two different modes including the electric-controlled brake and the manual emergency brake. In the first preferred embodiment, the resistance and brake control device 4 may be used to push the brake device 13 to provide the function of the manual emergency brake in addition to the function of the electric-controlled brake. Specifically, the resistance and brake control device 4 of the first preferred embodiment includes a housing 41, a hand lever 42, a moving block 43 combined to a lever body of the hand lever 42, a rotating member 44 combined to a working end 421 of the hand lever 42, a sensing unit 45 installed to the moving block 43 and configured to be corresponding to the rotating member 44, and a brake push rod 46 combined to the hand lever 42 or the moving block 43.

In an embodiment, the housing 41 has a cylindrical casing 411, and two covers 412 for sealing both upper and lower ends of the cylindrical casing 411, and the hand lever 42 has a rod 422 and a hand knob 423, wherein an end of the rod 422 is the working end 421 extended from the upper cover 412 into the housing 41, and the hand knob 423 is combined to the other end of the rod 422 and disposed at the top outside the housing 41. The moving block 43 may be a rectangular frame slidably installed in the housing 41 and rotatably combined with the rod 422 of the hand lever 42, so that the hand lever 42 can be rotated by itself and used for pressing or pushing the moving block 43. The brake push rod 46 has an end passing through the lower cover 412 to enter into the housing 41 and combined with the moving block 43 and the other end extended to the pushing end 461 outside the housing 41, and the pushing end 461 is provided for pushing the brake device 13 of the fitness bike 1, and the lever body of the brake push rod 46 has an elastic member 47 provided for pushing the brake push rod 46, the moving block 43 and the hand lever 42 to resume their original positions.

Figure 5:
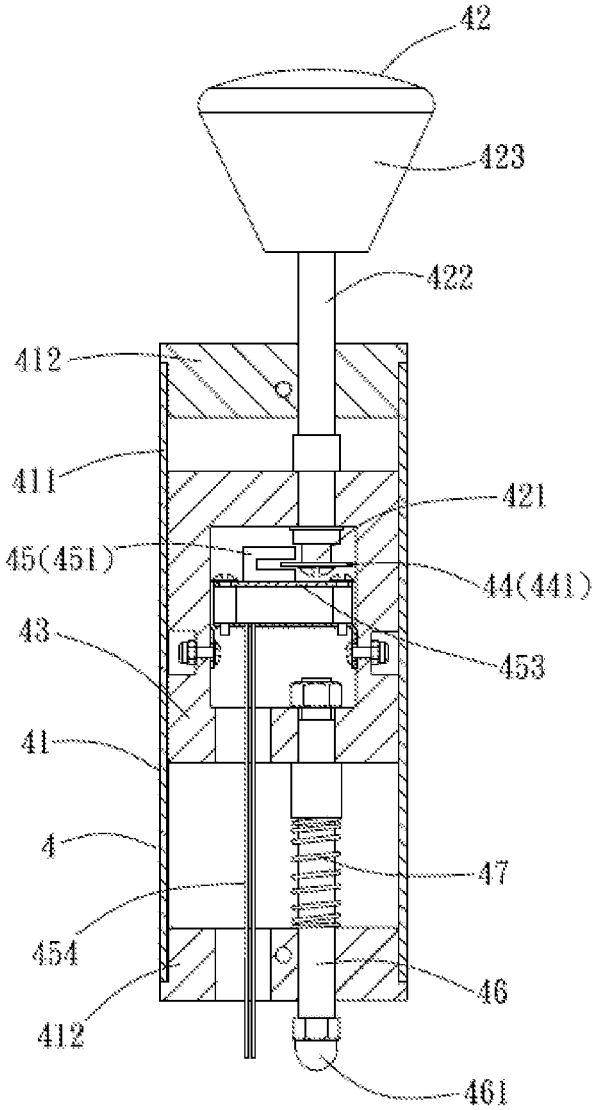
FIG. 5 is a schematic view of an encoder with photo-interrupter of a resistance and brake control device in accordance with the first embodiment of the present invention.
Figure 7:
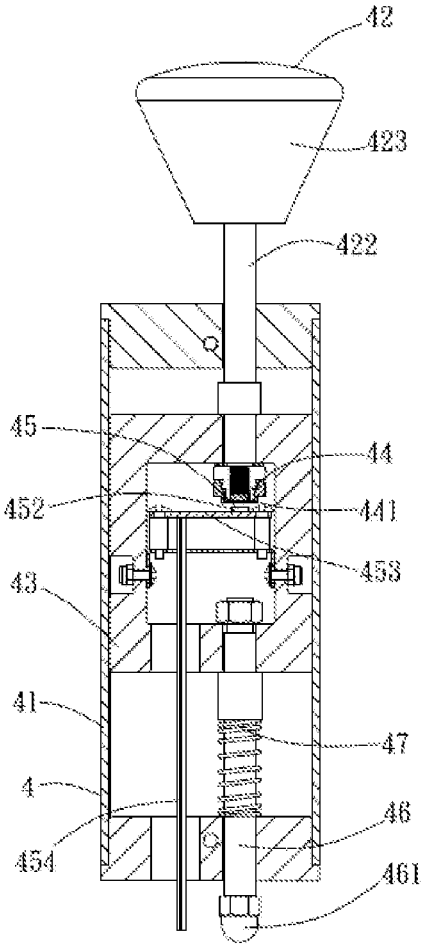
FIG. 7 is a schematic view of a Hall-effect sensor with magnet of a resistance and brake control device in accordance with the first embodiment of the present invention.
Figure 8:
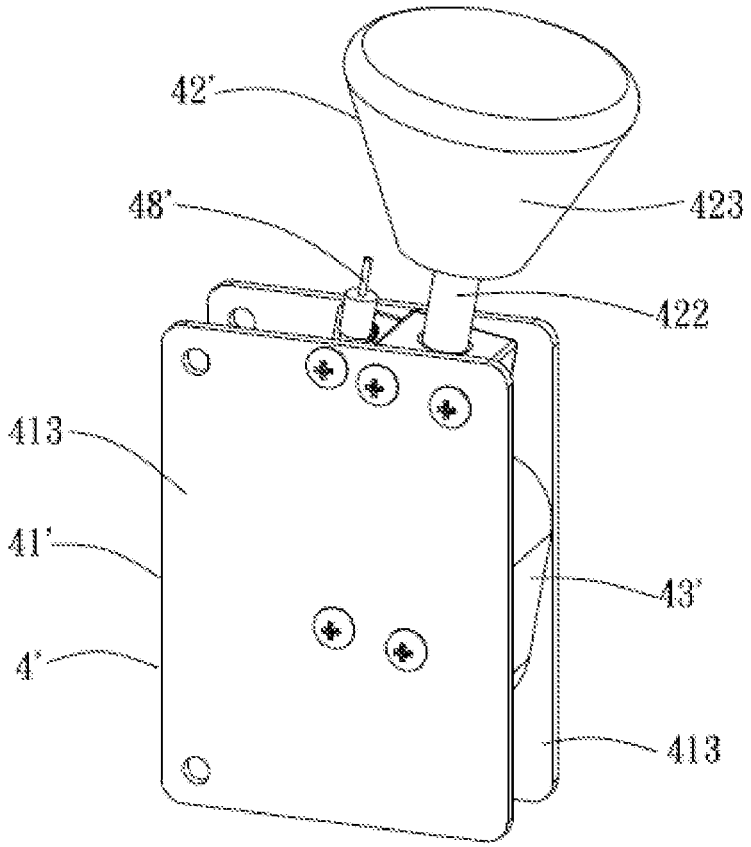
FIG. 8 is a schematic view of a resistance and brake control device in accordance with a second embodiment of the present invention.

When the resistance and brake control device 4 of the first embodiment of the present invention is used as shown in FIG. 5 or 7, the function of the continuously variable electric-controlled brake may be provided for user operation. A user turns the hand knob 423 of the hand lever 42, so that the rotating member 44 is rotated while the hand lever 42 is being turned. When the rotating member 44 is rotated, the sensing unit 45 senses the angle of rotation of the rotating member 44 to generate and feed back a signal to the console 2 or the control unit 5, so that the console 2 or the control unit 5 can control the magnetic damping or braking force to the flywheel 12 by the magnetic-controlled damping device 3. In FIG. 5, the resistance and brake control device 4 in accordance with the first embodiment of the present invention also provides the emergency braking function manually operated by the user, and the user presses the hand knob 423 of the hand lever 42 to push the moving block 43 and the brake push rod 46, so that the pushing end 461 of the brake push rod 46 pushes the bracket 131 of the brake device 13 of the fitness bike 1 and the brake pad 132 touches the flywheel 12 to achieve the manual emergency braking function mechanically.

Figure 6:
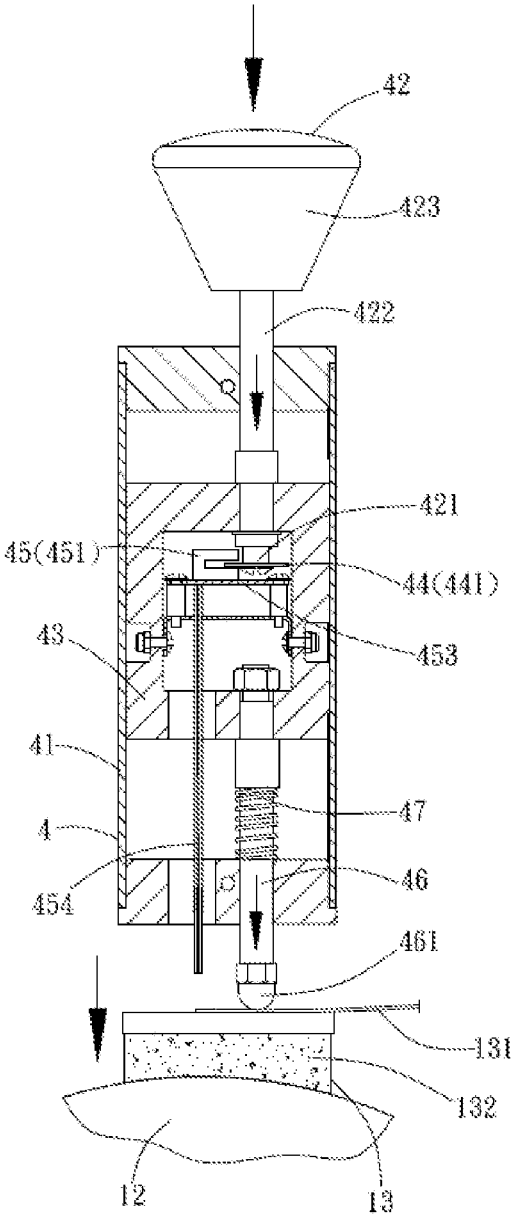
FIG. 6 is a schematic view of manually pressing a resistance and brake control device in accordance with the first embodiment of the present invention.

In the resistance and brake control device 4 of the first embodiment as shown in FIGS. 5 and 6, the rotating member 44 is physically an encoding disk 441 combined to the working end 421 of the hand lever 42, and the sensing unit 45 is an encoder 451 for reading the angle of rotation of the encoding disk 441. According to the angle rotated by the user, the encoder 451 feeds back a signal to the console 2 or the control unit 5, so that the magnetic-controlled damping device 3 controls the magnetic damping force with gradual change in a continuously variable manner or produces the braking force. In FIG. 7, the rotating member 44 may be substituted by a magnet 442, and the sensing unit 45 is a sensing chip 452 for sensing the angle of rotation of the magnet 442. Similarly, according to the angle of turning the hand lever 42 and the magnet 442 by the user, the sensing chip 452 senses and feeds back a signal to the console 2 to achieve the same electric-controlled function. In addition, the encoder 451 or the sensing chip 452 of the sensing unit 45 may be combined to a printed circuit board 453, and the signal is fed back to the console 2 through the printed circuit board 453 and a signal line 454 electrically coupled to the console 2, or via a wireless transmission.

Figure 9:
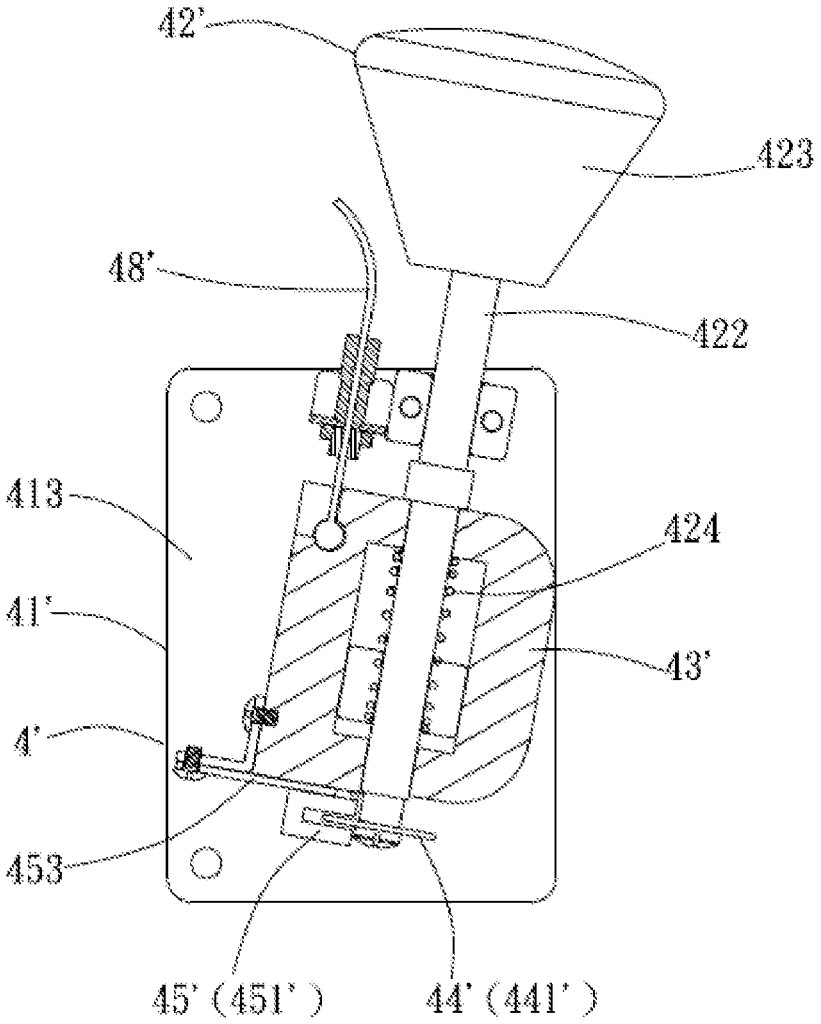
FIG. 9 is a schematic view of an encoder with photo-interrupter of a resistance and brake control device in accordance with the second embodiment of the present invention.
Figure 10:
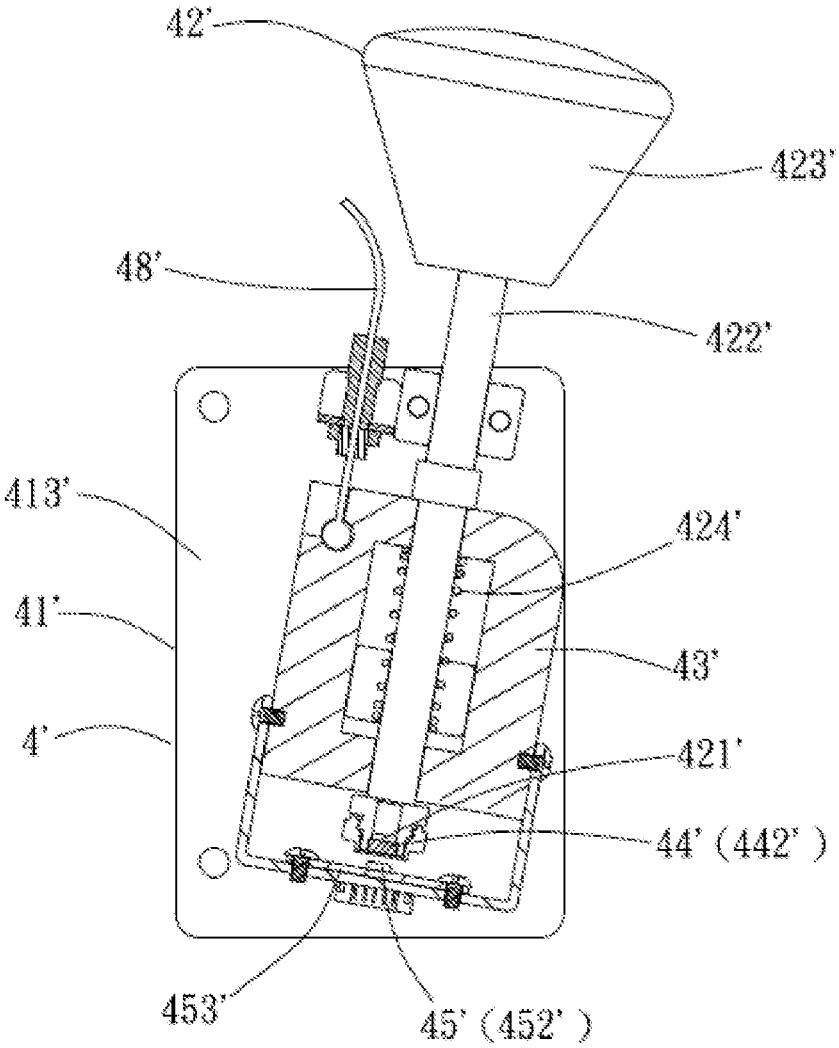
FIG. 10 is a schematic view of a Hall-effect sensor with magnet of a resistance and brake control device in accordance with the second embodiment of the present invention.

With reference to FIGS. 8 to 11 for the resistance and brake control device 4' in accordance with the second preferred embodiment of the present invention, the resistance and brake control device 4' also has the function of the electric-controlled brake, but the structure of the manual emergency brake and the brake push rod 46 are different from those of the first embodiment. Specifically, the resistance and brake control device 4' also includes a housing 41', a hand lever 42', a moving block 43' combined to a lever body of the hand lever 42', a rotating member 44' combined to a working end 421' of the hand lever 42', a sensing unit 45' installed onto the moving block 43' and configured to be corresponding to the rotating member 44', and a brake cable 48' coupled to the hand lever 42' or the moving block 43'. Wherein, the housing 41' is a structure formed by connecting two plates 413' by a plurality of fixing members (not shown in the figure), and the hand lever 42', the moving block 43', the rotating member 44' and the sensing unit 45' have the structures as those of the first preferred embodiment except that a rod 422' of the hand lever 42' has an elastic member 424' provided for pushing the moving block 43' and the hand lever 42' to their original positions. Particularly, the brake cable 48' is different from the brake push rod 46 and has an end coupled to the moving block 43' and the other end extended outside the housing 41' and connected to the brake device 13 of the fitness bike 1, or used for connecting the brake device 13 of a rear-flywheel fitness bike 1" (as shown in FIG. 11), so that when the hand lever 42' and the moving block 43' are pressed, the brake cable 48' drives the brake device 13, or the brake device 13' of the rear flywheel at a farther end. As a result, the resistance and brake control device 4' may be installed to an appropriate position more freely to fit various different models of the fitness bikes. In addition, the rotating member 44' and the sensing unit 45' of the second preferred embodiment are the same as those of the first preferred embodiment and may be an encoding disk 441' and an encoder 451' of the compatible models (as shown in FIG. 9), or a magnet 442' and a sensing chip 452' of the compatible models (as shown in FIG. 10) to achieve the same function as described above.

While the invention has been described by means of specific embodiments, numerous modifications and variations could be made thereto by those skill in the art without departing from the scope and spirit of the invention set forth in the claims.

What is claimed is:

1. A fitness machine with continuously variable magnetic-controlled damping force and combined with a manual emergency brake, comprising:

a fitness bike;

a console;

a magnetically controlled damping device; and a resistance and brake control device, wherein the fitness bike has a bike body, a flywheel installed to the bike body and pedaled to rotate by a user's leg, a brake device installed adjacent to the flywheel, a control unit combined into the bike body, a power generating device installed in the flywheel for generating electric power through a rotating moment and supplying the electric power to the control unit;

wherein the console is installed to the fitness bike and electrically coupled to the control unit and provided for the user's operation;

wherein the magnetically controlled damping device is combined with the bike body of the flywheel and electrically coupled to the console or the control unit for controlling the magnetically controlled damping device to produce a magnetic damping force to the flywheel;

wherein the resistance and brake control device includes a hand lever, a moving block combined with the lever body of the hand lever, a rotating member combined to a working end of the hand lever, a sensing unit installed to the moving block and configured to be corresponding to the rotating member, and a brake push rod combined to the hand lever or the moving block;

wherein the hand lever is turned while the rotating member is being rotated, and the sensing unit senses the angle of rotation of the rotating member to generate and feedback a signal to the control unit and provided for the control unit to control the magnetically controlled damping device to produce a magnetic damping force to the flywheel; and wherein the hand lever is provided for being pressed or pushed to drive the brake push rod, and the brake push rod is provided for pushing the brake device of the fitness bike.

2. The fitness machine with continuously variable magnetic-controlled damping force and combined with a manual emergency brake according to claim 1, wherein the magnetically controlled damping device has a yoke, and an electromagnetic coil wound around the yoke, and the yoke has two magnetic poles extended to both sides of the flywheel respectively and electrically coupled to the console or the control unit.

3. The fitness machine with continuously variable magnetic-controlled damping force and combined with a manual emergency brake according to claim 1, wherein the rotating member is an encoding disk, and the sensing unit is an encoder for reading the angle of rotation of the encoding disk.

4. The fitness machine with continuously variable magnetic-controlled damping force and combined with a manual emergency brake according to claim 1, wherein the rotating member is a magnet, and the sensing unit is a Hall-effect sensor for sensing the angle of rotation of the magnet.

5. The fitness machine with continuously variable magnetic-controlled damping force and combined with a manual emergency brake according to claim 3, wherein the sensing unit is combined with a printed circuit board, and the printed circuit board is electrically coupled to the console or the control unit.

6. The fitness machine with continuously variable magnetic-controlled damping force and combined with a manual emergency brake according to claim 4, wherein the sensing unit is combined with a printed circuit board, and the printed circuit board is electrically coupled to the console or the control unit.

7. The fitness machine with continuously variable magnetic-controlled damping force and combined with a manual emergency brake according to claim 1, wherein the resistance and brake control device includes a housing; the hand lever has a rod and a hand knob, and an end of the rod is the working end and extended into the housing, and the hand knob is combined to the other end of the rod and disposed outside the housing; the moving block is slidably installed in the housing and rotatably coupled to the rod; the brake push rod has an end of combined to the moving block and the other end extended to the pushing end outside the housing, and the pushing end is provided for pushing the brake device of the fitness bike; and the brake push rod has an elastic member, and the elastic member is provided for pushing the brake push rod, the moving block and the hand lever to resume their original positions.

8. A fitness machine with continuously variable magnetic-controlled damping force and combined with a manual emergency brake, comprising:

a fitness bike;

a console;

a magnetically controlled damping device; and a resistance and brake control device, wherein the fitness bike has a bike body, a flywheel installed to the bike body and pedaled to rotate by a user's leg, a brake device installed adjacent to the flywheel, a control unit combined into the bike body, and a power generating device installed in the flywheel for generating electric power through a rotating moment and supplying the electric power to the control unit;

wherein the console is installed to the fitness bike and electrically coupled to the control unit and provided for the user's operation; the magnetically controlled damping device is combined with the bike body of the flywheel and electrically coupled to the console or the control unit for controlling the magnetically controlled damping device to produce a magnetic damping force to the flywheel;

wherein the resistance and brake control device includes a hand lever, a moving block combined with the lever body of the hand lever, a rotating member combined to a working end of the hand lever, a sensing unit installed to the moving block and configured to be corresponding to the rotating member, and a brake cable combined to the hand lever or the moving block;

wherein the hand lever is turned while the rotating member is being rotated, and the sensing unit senses the angle of rotation of the rotating member to generate and feed back a signal to the control unit and provided for the control unit to control the magnetically controlled damping device to produce a magnetic damping force to the flywheel; and wherein the hand lever is provided for being pressed or pushed to drive the brake push rod, and the brake push rod is provided for pushing the brake device of the fitness bike.

9. The fitness machine with continuously variable magnetic-controlled damping force and combined with a manual emergency brake according to claim 8, wherein the magnetically controlled damping device has a yoke, and an electromagnetic coil wound around the yoke, and the yoke has two magnetic poles extended to both sides of the flywheel respectively and electrically coupled to the console and/or the control unit.

10. The fitness machine with continuously variable magnetic-controlled damping force and combined with a manual emergency brake according to claim 8, wherein the rotating member is an encoding disk, and the sensing unit is an encoder for reading the angle of rotation of the encoding disk.

11. The fitness machine with continuously variable magnetic-controlled damping force and combined with a manual emergency brake according to claim 8, wherein the rotating member is a magnet, and the sensing unit is a Hall-effect sensor for sensing the angle of rotation of the magnet.

12. The fitness machine with continuously variable magnetic-controlled damping force and combined with a manual emergency brake according to claim 10, wherein the sensing unit is combined to a printed circuit board, and the printed circuit board is electrically coupled to the console or the control unit.

13. The fitness machine with continuously variable magnetic-controlled damping force and combined with a manual emergency brake according to claimll, wherein the sensing unit is combined to a printed circuit board, and the printed circuit board is electrically coupled to the console or the control unit.

14. The fitness machine with continuously variable magnetic-controlled damping force and combined with a manual emergency brake according to claim 8, wherein the resistance and brake control device includes a housing; the hand lever has a rod and a hand knob, and an end of the rod is the working end and extended into the housing, and the hand knob is combined to the other end of the rod and disposed outside the housing; the moving block is slidably installed in the housing and rotatably coupled to the rod; the brake push rod has an end of combined to the moving block and the other end extended to the pushing end outside the housing, and the pushing end is provided for pushing the brake device of the fitness bike; and the brake push rod has an elastic member, and the elastic member is provided for pushing the brake push rod, the moving block and the hand lever to resume their original positions.

* * * * *